US006902428B2

(12) United States Patent
Wong

(10) Patent No.: US 6,902,428 B2
(45) Date of Patent: Jun. 7, 2005

(54) CONNECTOR WITH CHANGEABLE CONNECTING MANNER

(75) Inventor: Man-Wai Wong, Taoyuan (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/720,366

(22) Filed: Nov. 24, 2003

(65) Prior Publication Data

US 2004/0110408 A1 Jun. 10, 2004

(30) Foreign Application Priority Data

Dec. 4, 2002 (TW) ..... 91219665 U

(51) Int. Cl.[7] ..... H01R 13/66
(52) U.S. Cl. ..... 439/528; 439/501
(58) Field of Search ..... 439/528, 501, 439/542, 543, 536; 191/12–4

(56) References Cited

U.S. PATENT DOCUMENTS 6,379,178 B1 * 4/2002 Jones et al. ..... 439/501

* cited by examiner

*Primary Examiner*—Ross Gushi
(74) *Attorney, Agent, or Firm*—Snell & Wilmer L.L.P.

(57) ABSTRACT

The present invention provides a connector for connecting a first electronic device to a second electronic device. The connector includes a body, a wire and a plug. The wire passing through a space of the body has a first end and a second end. The first end is configured to connect to the first electronic device. The plug has a third end configured to connect to the second end. Accordingly, the plug is selectively disposed in the space or outside the space by means of the wire to connect to the second electronic device.

1 Claim, 3 Drawing Sheets

CONNECTOR WITH CHANGEABLE CONNECTING MANNER

CROSS-REFERENCE TO RELATED APPLICATIONS

This application claims priority of Taiwan Patent Application Serial No. 091219665 filed on Dec. 4, 2002.

FIELD OF INVENTION

The present invention relates to a connector, and especially to a connector with a changeable connecting manner.

BACKGROUND OF THE INVENTION

A connector connects a first electronic device, such as a card reader, to a second electronic device, like a computer, and transmits information between them. One end of the connector is then inserted into a first socket of the second electronic device. However, connectors with large size, such as conventional universal serial bus (USB) connectors, would hinder a third electronic device from connecting to a second socket adjacent to the first socket of the second electronic device through another connector.

Although extra extended-lines between the connector and the socket could solve the above-mentioned problem, it is inconvenient for users to handle them. Consequently, a connector without extra accessories and occupying less space is required.

SUMMARY OF THE INVENTION

The present invention provides a connector for connecting a first electronic device to a second electronic device. The connector includes a body, a wire and a plug.

In accordance with one embodiment of the invention, the body defines a space for the wire to pass through. The wire has a first end and a second end. The first end is configured to connect to the first electronic device. The plug has a third end configured to connect to the second end. Accordingly, the plug is selectively disposed in the space or outside the space by means of the wire to connect to the second electronic device.

DETAILED DESCRIPTION

Figure 1:
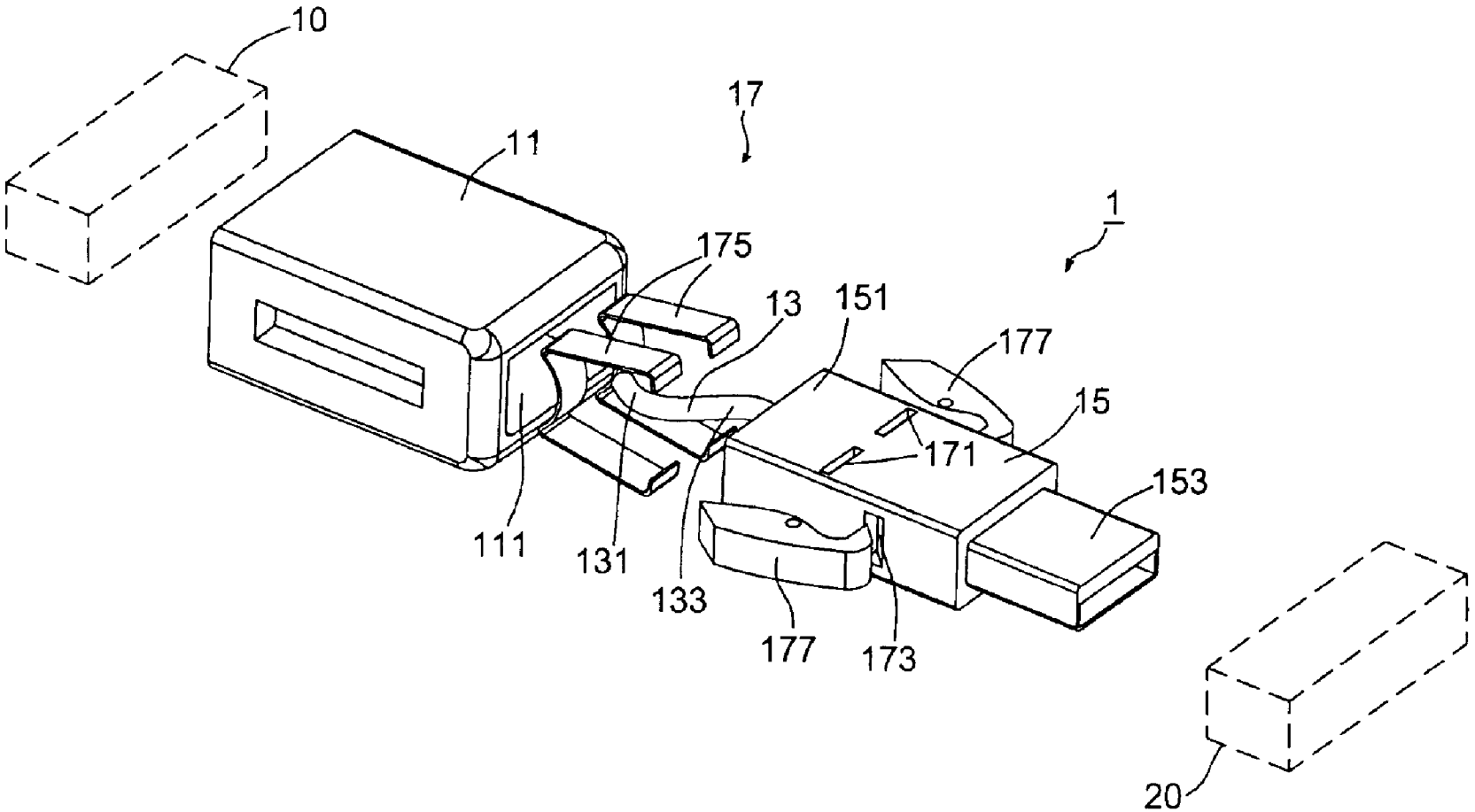
FIG. 1 is an explosive view of an exemplary embodiment of the present invention.

As shown in FIG. 1, the present invention provides a connector 1 for connecting a first electronic device 10 (depicted with dash line) to a second electronic device 20 (depicted with dash line). Here the second electronic device 20 has a socket (not shown). Additionally, the connector 1 may be integrated in to the first electronic device 10.

The connector 1 includes a body 11, a wire 13 and a plug 15. The body 11 defines a space 111 for the wire 13 to pass through. The wire 13 has a first end 131 and a second end 133. The first end 131 is configured to connect to the first electronic device 10. The plug 15 has a third end 151 and a fourth end 153. The third end 151 is configured to connect to the second end 133 of the wire 13. The fourth end 153 is configured to insert into the socket of the second electronic device 20.

Accordingly, when there is enough room around the socket, the plug 15 may be disposed in the space 111 to connect to the socket. And when there is not enough room around the socket, the plug 15 may be configured outside the space 111 by means of the wire 13 to connect to the socket. In other words, depending on the room available, the plug 15 could be selectively disposed in the space 111 or outside the space 111 by means of the wire 13 in order to connect to the second electronic device 20. Therefore, the connector 1 of the present invention works without the limits of room available, does not need extra accessories, and is still easy to use and carry.

Figure 2A:
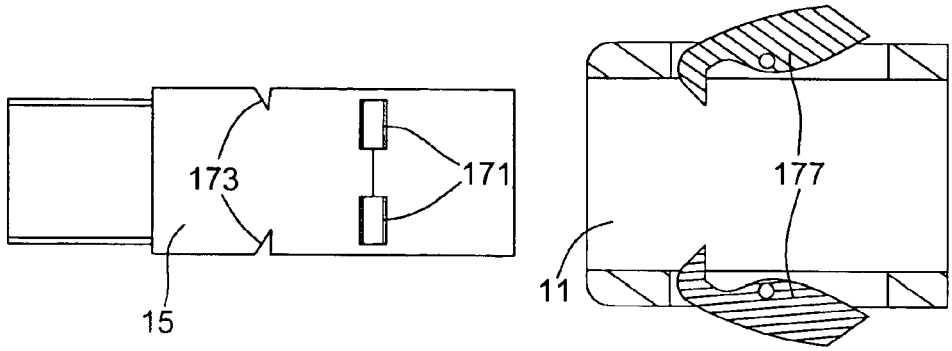
FIG. 2A is a top view of the body and the plug of the exemplary embodiment when they separated.
Figure 2B:
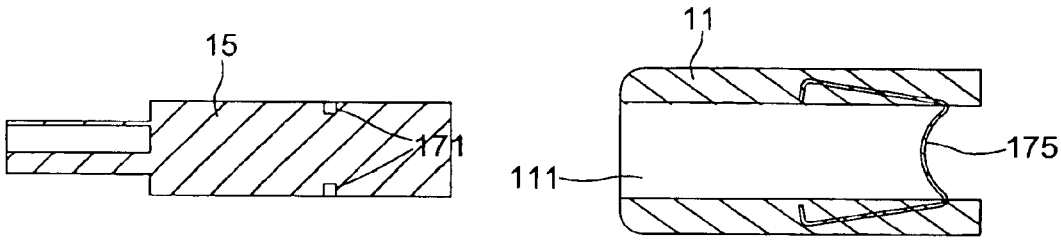
FIG. 2B is a side view of the body and the plug of the exemplary embodiment separated.
Figure 3A:
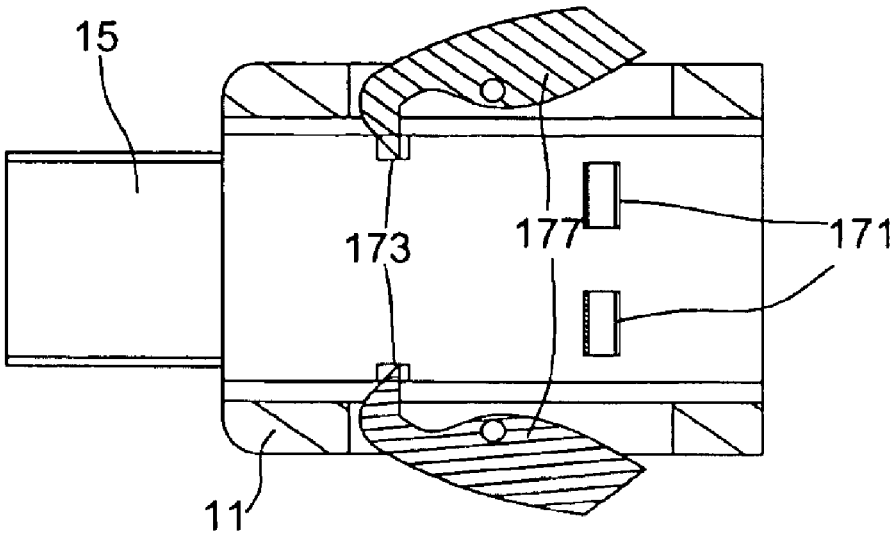
FIG. 3A is a top view of the body and the plug of the exemplary embodiment combined.
Figure 3B:
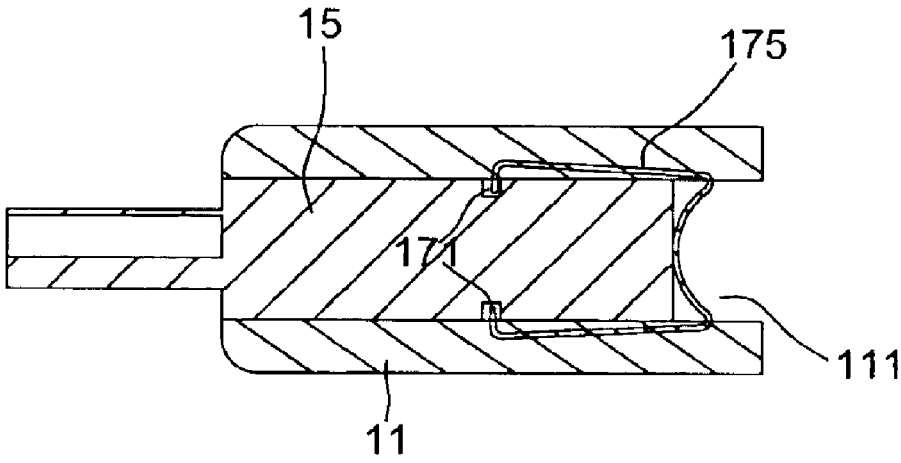
FIG. 3B is a side view of the body and the plug of the exemplary embodiment combined.

The present invention may further include a latch set 17. The latch set 17 includes a first latch 175, a second latch 177, and corresponding holes 171 and 173. The holes 171 and 173 are disposed on the plug 15. When there is not enough room around the socket, the user may separate the plug 15 from the body 11, as shown in FIGS. 2A and 2B. And when there is enough room around the socket, the user may combine the plug 15 with the body 11. Then the latch 175 is received in the hole 171, and the latch 177 is received in the hole 173, as shown in FIGS. 3A and 3B. Thus the latch set 17 helps fix the plug 15 in the space 111. In this embodiment, the first latch 175 may be a flexible plate, or any other elements having similar functions.

In this embodiment, the connector 1 is for connecting a first electronic device 10 applying to universal serial bus to a second electronic device 20. The first electronic device 10 may be a video/audio apparatus, a personal digital assistant (PDA), a notebook, a digital camera, a card reader or any signal terminal. The second electronic device 20 may be a personal computer (PC), a video/audio player or any signal processing apparatus.

While this invention has been described with reference to the illustrative embodiment, these descriptions should not be construed in a limiting sense. Various modifications of the illustrative embodiment, as well as other embodiments of the invention, will be apparent upon reference to these descriptions. It is therefore contemplated that the appended claims will cover any such modifications or embodiments as falling within the true scope of the invention and its legal equivalents.

I claim:

1. A universal serial bus (USB) connector for connecting a first electronic device to a second electronic device, said second electronic device having a universal serial bus socket, said universal serial bus connector comprising:

a body defining a space;

a wire passing through said space, said wire having a first end and a second end, wherein said first end is configured to connect to said first electronic device;

a latch; and a plug having a hole corresponding to said latch, a third end and a fourth end, wherein said third end is configured to connect to said second end, and said fourth end is configured to insert into said universal serial bus socket;

wherein said plug is selectively disposed in or outside said space to connect to said universal serial bus socket, and said latch is received in said hole when said plug is disposed in said space.

* * * * *